US005085122A

United States Patent [19]

Berlam et al.

[11] Patent Number: 5,085,122

[45] Date of Patent: Feb. 4, 1992

[54] FIRING ASSEMBLY FOR STORED ENERGY LAUNCHER

[75] Inventors: Gary R. Berlam, Warwick; Laurent C. Bissonnette, Narragansett; Nicholas Bitsakis, Portsmouth; Peter R. Bodycoat, Newport; George M. Duarte, Cranston, all of R.I.

[73] Assignee: The United States of America as represented by the Secretary of the Navy, Washington, D.C.

[21] Appl. No.: 652,155

[22] Filed: Feb. 7, 1991

[51] Int. Cl.[5] ..... F41F 3/08

[52] U.S. Cl. ..... 89/1.81; 114/238; 114/319

[58] Field of Search ..... 114/238, 319; 42/1.14; 89/1.809, 1.810, 1.806

[56] References Cited

U.S. PATENT DOCUMENTS

| | | | |
|---|---|---|---|
| 709,335 | 9/1902 | Lake | 114/319 |
| 1,526,256 | 2/1925 | Techel | 114/238 |
| 3,548,708 | 12/1970 | Hubigh | 89/1.806 |
| 4,376,405 | 3/1983 | Madderra | 89/1.806 |
| 4,523,538 | 6/1985 | Hollmann et al. | 114/238 |
| 4,848,210 | 7/1989 | Bissonnette | 89/1.810 |

FOREIGN PATENT DOCUMENTS

| | | | |
|---|---|---|---|
| 303621 | 12/1932 | Italy | 114/238 |

*Primary Examiner*—David H. Brown
*Attorney, Agent, or Firm*—Michael J. McGowan; Prithvi C. Lall; Michael F. Oglo

[57] ABSTRACT

A firing assembly for a stored energy projectile launcher of the type having an energy storage device that is pressurized by a fluid. The projectile is mechanically latched in its launch tube and the aft end of the projectile cooperates with the breach end of the launch tube to define a breach chamber that communicates with and is pressurized with the bladder. A valve in a line from the breach chamber is electrically controlled to move a piston and release the mechanical latch when fluid pressure is provided to the piston chamber. The pressure used to overcome the force needed to raise the piston is taken from the energy storage device. No addition of energy to the system is required, with the exception of a short electrical impulse signal, to open a full port valve acting instantaneously on the rear face of the projectile.

9 Claims, 1 Drawing Sheet

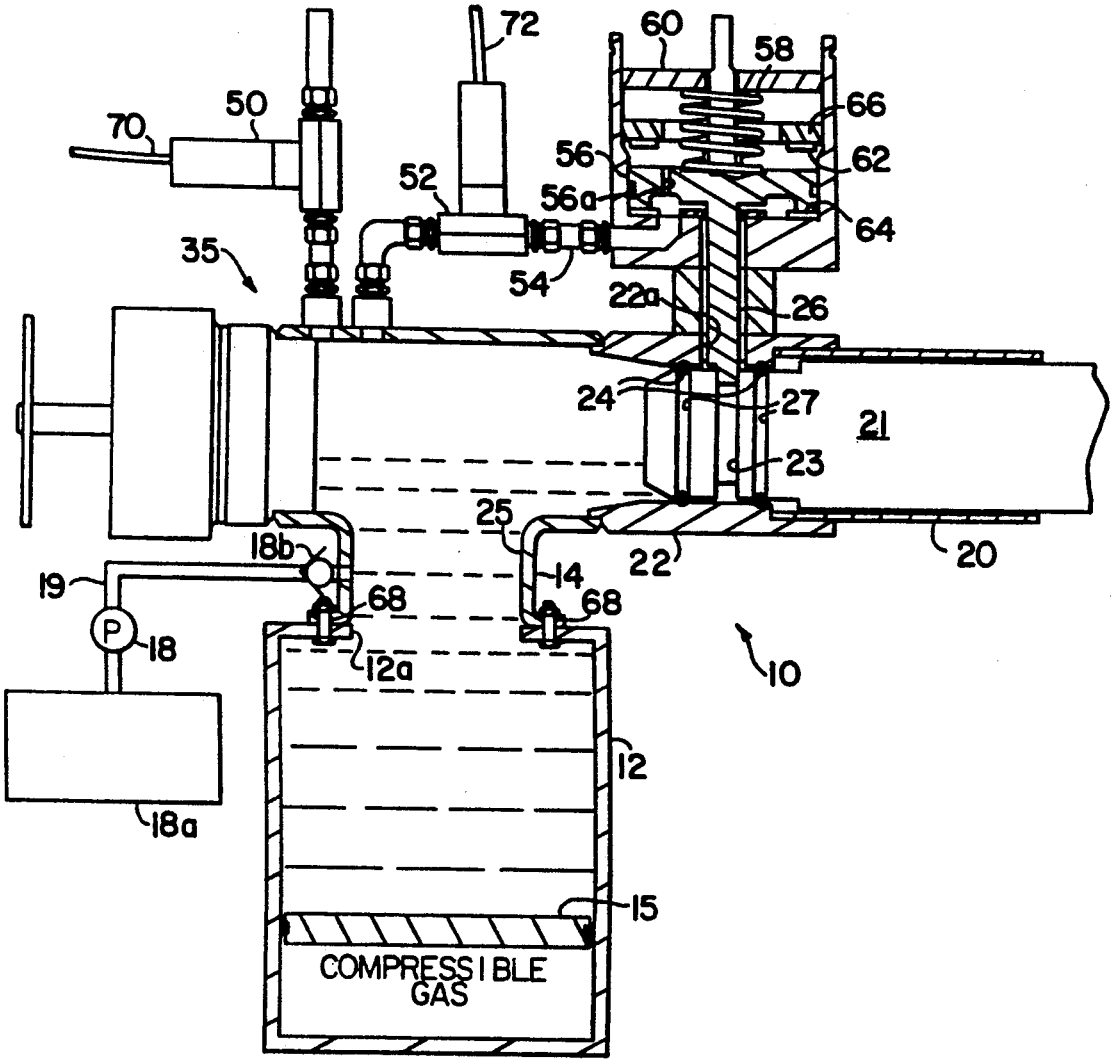
72
60
58
50
70
66
56
62
52
56a
64
35
54
22a
26
24
27
21
23
25
18b
22
20
19
14
68
68
P
18
12a
10
12
18a
15
COMPRESSIBLE
GAS

FIRING ASSEMBLY FOR STORED ENERGY LAUNCHER

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates to projectile launchers for underwater platforms, and deals more particularly with an improved firing assembly for a stored energy launcher system.

(2) Description of the Prior Art

In U.S. Pat. No. 4,848,210 an elastomeric bladder is provided as an energy storage device used in association with a projectile launch tube in the free flood compartment of a submarine hull. In this prior art system, a slide valve is provided to isolate the pressurized storage device from the breach end of the launch tube.

Problems associated with providing a slide valve to isolate the pressurized storage device are numerous. One major drawback is that the isolation valve must open very rapidly for the launch system to operate properly. Should the valve open slowly, the water in the energy storage device would become throttled through the valve, thereby limiting the flow rate through the system. The slide valve is also a very complex mechanical system. This, coupled with the fast opening times required, creates increasingly higher levels of structureborne vibrations. Lastly, energy must be added to the slide valve to cause it to operate (qenerally in the form of pressurized hydraulic fluid through power cylinders). Minimizing energy inputs to a system is generally known to minimize vibrations.

SUMMARY OF THE INVENTION

An object of the present invention is to provide a more efficient launching or firing mechanism which will permit the projectile to be launched remotely, and which will permit the pressurized fluid within the energy storage device to be instantaneously applied to the rear of the projectile, rather than providing a slide valve between the pressurized fluid and the end of the projectile, as taught in the U.S. Pat. No. 4,848,210.

Additional objects of the present invention are to simplify the system, to minimize the vibrations of the system while operating, and to reduce the cost of fabricating the system. Reduction in structureborne vibrations will be realized jointly through the simplification of the system, and through the use of the internal pressure of the energy storage device to actuate the system, thereby eliminating any additional energy added.

In accordance with the present invention, an energy storage device is provided in continuous communication with the interior of the launch tube itself. The breach end of the launch tube may be fitted with a conventional access port for placing a projectile within the tube, and the projectile is provided forwardly of the breach end of the tube in accordance with conventional practice. A fluid operated piston is provided to retain the projectile in position against the pressure imparted to the rear of the projectile by the energy storage device, and a valve is provided between the piston chamber and the pressurized end of the launcher tube associated with the energy storage device. The projectile is thereby held mechanically in place until the valve is electrically operated to "fire" the projectile. A vent valve is provided for venting air from the system prior to flooding the system and pressurizing the system with water. This vent valve can also be used to discharge any stored energy in the system in the event that the projectile does not eject upon command.

BRIEF DESCRIPTION OF THE DRAWING

The sole drawing shows a launcher tube equipped with a firing assembly of the present invention and also illustrates an energy storage device, which may be an elastomeric bladder, a hydraulic bladder type accumulator, a spring loaded piston, etc.

DESCRIPTION OF THE PREFERRED EMBODIMENT

Referring now to the drawing in greater detail, a projectile launching system 10 incorporating the present invention is shown. An energy storage device shown generally at 12 connects by means of a flanged tube 14 to the breach end of launching system 10. While a single launching tube 20 is shown, it is understood that a typical launcher system may comprise a plurality of such tubes by providing appropriate piping and valving so as to provide pressurized fluid to one or more preselected launching tubes.

In the single launch tube illustrated in the figure, the breach end 35 of the tube 2 is of conventional construction and will permit loading of a projectile such as that indicated generally at 21. This loading process is carried out from the muzzle end of the tube 20 (not shown). The projectile 21 is generally cylindrical and includes two or more "O" ring seals 24 situated in grooves 27, which are provided on either side of an annular groove 23 in the aft end of the projectile 21. The collar 22 defines a radially extending opening **22*a* for slidably receiving a piston actuator 26. The end of the piston actuator 26 is adapted to be received in this annular groove 23 of the projectile 21 in order to retain the projectile 21 in the position shown against fluid pressure in a breach chamber at the breach end 35** of the launch tube.

Means are provided for pressurizing the breach end of the launch tube. The preferred means for pressurizing the breach end of the launch tube includes a pump 18 which is adapted to be connected to a source of water, indicated generally at **18*a*, in order to provide fluid pressure in the line 19. That fluid pressure passes through a one way check valve, 18*b*, which prevents the pressure from relieving when the pump 18 is stopped. A valve 50 is electrically controlled through the line 70 and the valve element is adapted to normally close off the breach end 35 of the launch tube. This valve 50** is also used to vent any entrapped air from the system while pressurizing the breach end of the launch tube.

Energy storage device 12 may comprise an element similar to the one shown in U.S. Pat. No. 4,848,210, or may instead comprise any equivalent energy storage device configuration where the internal volume of an impulse tank is defined only in part by the energy storage device, being defined also in part by any other convenient structure.

A launch valve indicated generally at 52 controlled by electrical impulse through line 72 is provided in the line 54 and provides for selectively communicating the breach chamber 35 at the breach end of the launch tube 20 and the piston chamber, i.e., the actuating chamber associated with piston 56. This piston 56 operates the projectile retaining actuator 26, and a spring 58 is provided between the piston cylinder head 60 and the piston 56 to mechanically hold the actuator 26 in position for retaining the projectile 21 in the launch tube against possible leaks of fluid from the breach chamber past O-ring 24 thereby acting on the lower side of piston 56. A small hole, 56*a*, is provided in the piston 56 to allow any of the leaked fluid to escape to the surrounding medium. Valve 52 permits pressurized fluid to be provided to the underside of the piston 56. Valve 52, like valve 50, is electrically operated and the valve element normally closes the line 54, except when the valve 52 is electrically energized.

Rubber bumpers 62 and 64 are preferably provided inside the piston chamber as indicated generally at 62 and 64. Bumpers 64 are affixed to one side of intermediate ring 66. These rubber bumpers 62 and 64 engage the piston 56 at its opposed limits of travel during operation of the projectile launching system.

Thus, and in accordance with the present invention, the energy storage device 12 is continually connected to the breach end of the launch tube through opening 25 in tube 14. The energy storage device preferably has a neck portion 12(*a*) adapted to be received externally on one end of tube 14. A multitude of bolts 68 are preferably provided around the flanged neck portion of the tube 14 in order to secure the energy storage device in the position shown and to anchor this portion of the energy storage device in fixed relationship to the launch tube 20.

As so constructed and arranged, the stored energy launcher is adapted to be provided externally of the submerged vessel, or in the free flood compartment of a submarine, and with a projectile inserted in the launch tube, the projectile can be locked in place with the actuator 26. "O" ring seals are provided at the aft end of the projectile and these sealing elements serve to isolate the pressurized fluid within the energy storage device 12 and the breach chamber at the breach end 35 of the launch tube 20 itself. Once this volume within device 12 and the breach end of the launch tube has been provided with pressurized water as shown generally by the dashed lines in the drawing, the pressurization pump is no longer required and may be disconnected from the system. The remaining assembly can then be submerged to any depth for firing. The provision of a spring 58 acting on the piston 56 serves to maintain the projectile 21 in place even if a leak should develop around the "O" ring seals 24,24 or through a small leak in valve 52. Launching of the projectile is achieved by electrically energizing the launch valve 52. This valve opens line 54 and ports a large volume of pressurized water to the bottom of the piston, causing the actuator 26 to translate upward, as seen in the Figure. This configuration provides an instant opening full bore valve for delivering all of the fluid pressure stored in the energy storage device or impulse tank 12, virtually instantaneously to the projectile 21 to be launched. As shown this energy storage device 12 comprises a chamber with a movable piston 15. Gas behind the piston is pressurized when the fluid above the piston is pressurized. Other energy storage devices might be substituted for this accumulator type device without departing from the scope of the invention. Thus, the projectile is launched out of its barrel or launch tube at relatively high velocity with a minimum of delay time. The electrically controlled valve 52 permits the projectile to be launched by a remote control circuit. The electrically controlled valves 50 and 52 are electrically connected to suitable control circuits by the leads 70 and 72 respectively.

In light of the above, it is therefore understood that within the scope of the appended claims, the invention may be practiced otherwise than as specifically described.

What is claimed is:

1. A projectile launching system comprising:

at least one launch tube having a breach end portion;

a cylindrical projectile having forward and aft ends, said aft end further having first and second circular sealing means disposed thereabout for sealing said launch tube around said projectile in an area adjacent said restraining means, said breach end of said launch tube cooperating with said aft end of said projectile and said first and second sealing means to define a breach chamber;

an impulse tank including an energy storage device, said tank having a neck portion defining an opening, said tank and said breach chamber being in continuous communication with one another;

means for providing fluid under pressure to said breach chamber and to said impulse tank in order to pressurize said storage device and thereby store energy therein;

projectile restraining means for engaging said projectile forward of said first sealing means and restraining said projectile from movement in said launch tube as said breach chamber is so pressurized; and projectile release means for releasing said projectile restraining means thereby launching said projectile under the pressure of said fluid as supplemented by the energy stored in said storage device.

2. The system according to claim 1 wherein said restraining means comprises a fluid operated piston device having a movable piston portion defining a mechanical latch that cooperates with said projectile to restrain said projectile, said fluid operated piston device further having a fixed cylinder portion cooperating with said movable piston portion thereof to define an actuating chamber.

3. The system according to claim 2 wherein said projectile release means includes said actuating chamber, first conduit means for connecting said actuating chamber to said breach chamber, and first valve means in said first conduit means for controlling the operation of said projectile release means.

4. The system according to claim 3 wherein said means for providing fluid under pressure includes a port defined by said breach chamber, a second conduit means having one end selectively connected to a source of water under pressure and the other end of said second conduit means connected to said port, and second valve means provided in said second conduit means.

5. The system according to claim 3 wherein said first valve means is electrically controlled.

6. The system according to claim 5 wherein said means for providing fluid under pressure includes a port defined by said breach chamber, a conduit having one end selectively connected to a source of water under pressure and the other end of said conduit connected to said port, and check valve means provided in said conduit.

7. The system according to claim 3 wherein said fluid operated piston device further includes bumpers provided in said fixed cylindrical housing portion to be engaged by said piston at the limits of its stroke.

8. The system according to claim 7 wherein said piston is fluid operated in a direction to release said projectile restraining means, and biased by spring means for returning said piston to a normal position wherein said projectile is restrained in said launch tube independently of the presence or absence of fluid pressure in said breach chamber.

9. A method of launching a projectile comprising the steps of:

providing a submersible assembly including a launch tube and impulse tank;

loading a projectile into the launch tube, and latching the projectile in the launch tube such that the aft end of the projectile cooperates with the breach end to define a breach chamber;

pressurizing the breach chamber and impulse tank from a source of fluid under pressure;

submerging the launch tube and tank assembly; and electrically operating a valve provided in the submerged assembly from a remote location to direct pressurized fluid to a fluid actuator from the breach chamber of the launch tube in order to unlatch the projectile simultaneously with providing fluid pressure from the impulse tank instantaneously to the aft end of the projectile.

* * * * *